US006013988A

United States Patent [19]

Bucks et al.

[11] Patent Number: 6,013,988

[45] Date of Patent: Jan. 11, 2000

[54] CIRCUIT ARRANGEMENT, AND SIGNALLING LIGHT PROVIDED WITH THE CIRCUIT ARRANGEMENT

[75] Inventors: Marcel J. M. Bucks; Engbert B. G. Nijhof, both of Eindhoven, Netherlands

[73] Assignee: U.S. Philips Corporation, New York, N.Y.

[21] Appl. No.: 09/128,147

[22] Filed: Aug. 3, 1998

[30] Foreign Application Priority Data

Aug. 1, 1997 [EP] European Pat. Off. ..... 97202399

[51] Int. Cl.[7] ..... H05B 37/00

[52] U.S. Cl. ..... 315/307; 315/291; 315/297

[58] Field of Search ..... 315/291, 307, 315/306, 225, 224, 287, DIG. 5, 297

[56] References Cited

U.S. PATENT DOCUMENTS 4,577,320 3/1986 Yoshikawa et al. ..... 372/29

5,028,862 7/1991 Roth ..... 315/291

5,612,596 3/1997 Wiese ..... 315/291

FOREIGN PATENT DOCUMENTS 2172120 9/1986 United Kingdom .

*Primary Examiner*—Don Wong

*Assistant Examiner*—Tuyet Vo

*Attorney, Agent, or Firm*—Edward W. Goodman

[57] ABSTRACT

A circuit arrangement for operating a semiconductor light source includes connection terminals for connection to a control unit, an input filter, a converter having a control circuit, and output terminals for connection to the semiconductor light source. The circuit arrangement is also provided with a self-regulating current-conducting network.

5 Claims, 3 Drawing Sheets

CIRCUIT ARRANGEMENT, AND SIGNALLING LIGHT PROVIDED WITH THE CIRCUIT ARRANGEMENT

Circuit arrangement, and signalling light provided with the circuit arrangement.

BACKGROUND OF THE INVENTION

1. Field of the Invention

The invention relates to a circuit arrangement for operating a semiconductor light source provided with:

connection terminals for connection to a control unit, input filter means, a converter comprising a control circuit, and output terminals for connection to the semiconductor light source. The invention also relates to a signalling light provided with such a circuit arrangement.

2. Description of the Related Art

Semiconductor light sources are increasingly used as signalling lights. A semiconductor light source in such an application has the advantage over a usual incandescent lamp that it has a longer life and a considerably lower power consumption than the incandescent lamp. Signalling lights often form part of a complicated signalling system, for example, a traffic control system with traffic lights. It is necessary for the circuit arrangement to provide retrofit possibilities in respect of existing signalling systems if the above advantages of semiconductor light sources are to be realized on a wide scale.

A signalling light in an existing signalling system is often controlled by means of a control unit which includes a solid state relay, a status test of the relay and of the signalling light taking place at the connection terminals of the connected circuit arrangement. It is a general property of solid state relays that a leakage current occurs in the non-conducting state of the relay. The use of a semiconductor light source is apt to give rise to an incorrect outcome of the status test. This is a problem in the use of the semiconductor light source.

SUMMARY OF THE INVENTION

It is an object of the invention to provide a measure by which the above problem is eliminated.

According to the invention, this object is achieved in that the circuit arrangement is, in addition, provided with a self-regulating current-conducting network. It is possible, thanks to the self-regulating current-conducting network, to drain off a leakage current occurring in the control unit while the control unit, for example, a solid state relay, is in the non-conducting state, and thus, to keep the voltage at the connection terminals of the circuit arrangement below a level required for a correct outcome of the status test. It is realized, thereby, in a simple and effective manner, that the circuit arrangement exhibits a characteristic at its connection terminals which corresponds, to a high degree, to the characteristic of an incandescent lamp.

An important feature of an incandescent lamp characteristic in this respect is a comparatively low impedance of the lamp in the extinguished state, with the result that the removal of the leakage current through the incandescent lamp leads to only a low voltage at the connection terminals of the control circuit.

Preferably, the circuit arrangement according to the invention comprises means for deactivating the self-regulating current-conducting network when the converter is switched on, which has the advantage that unnecessary power dissipation is counteracted. In an advantageous embodiment of the circuit arrangement according to the invention, the circuit arrangement is provided with a stabilized low-voltage supply, and the self-regulating current-conducting network in the activated state forms a supply source for said stabilized low-voltage supply. This embodiment has the major advantage that the stabilized low-voltage supply delivers the required low voltage very quickly upon switching-on of the converter by means of the control circuit, for example, the solid state relay, entering the conducting state, because the self-regulating current-conducting network has already been activated.

In the present description, the term "converter" is understood to mean an electrical circuit by means of which an electrical power supplied by the control circuit is converted into a current-voltage combination required for operating the semiconductor light source. Preferably, a switched-mode power supply fitted with one or several semiconductor switches is used for this purpose. Since modern switch-mode power supplies are often DC—DC converters, it is preferable for the input filter means to be also provided with rectifier means, which are known per se.

Preferably, a signalling light is provided with a housing containing a semiconductor light source according to the invention and also provided with the circuit arrangement according to the invention. The possibilities of using the signalling light as a retrofit unit for an existing signalling light are strongly increased thereby. The application possibilities as a retrofit signalling light are optimized when the circuit arrangement is provided with a housing which is integrated with the housing of the signalling light.

BRIEF DESCRIPTION OF THE DRAWING

The above and further aspects of the invention will be explained in more detail below with reference to a drawing of an embodiment of the circuit arrangement according to the invention, in which.

DESCRIPTION OF THE PREFERRED EMBODIMENT

Figure 1:
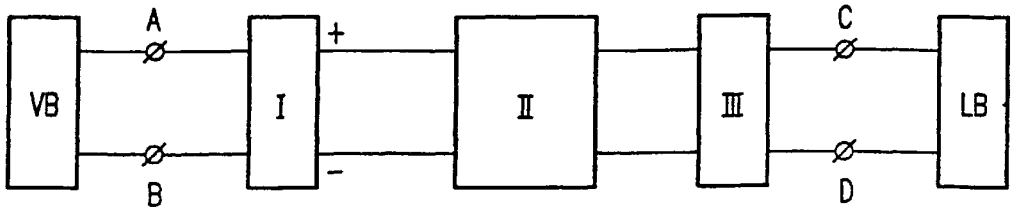
FIG. 1 is a block diagram of the circuit arrangement.

In FIG. 1, A and B are connection terminals for connection to a control unit VB, for example, provided with a solid state relay. Reference I denotes input filter means, and III a converter with a control circuit. C and D are output terminals for connecting the semiconductor light source LB. II denotes a self-regulating current-conducting network. The input filter means I are provided with a positive pole + and a negative pole −.

Figure 2:
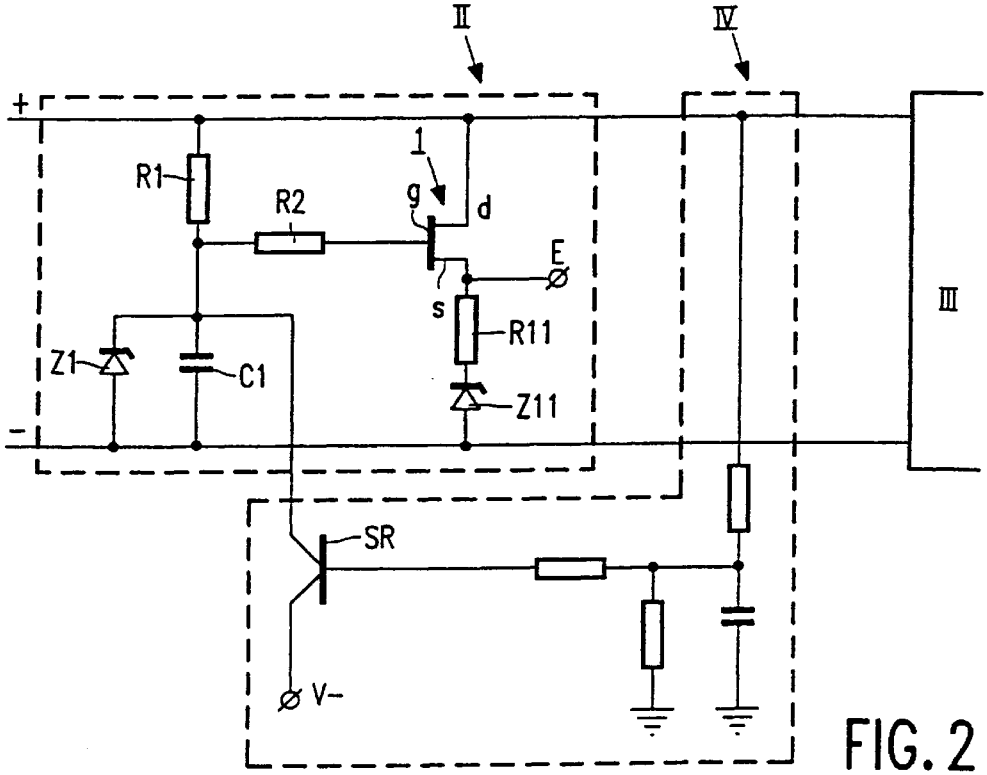
FIG. 2 is a circuit diagram showing a self-regulating current-conducting network in more detail.

The self-regulating current-conducting network II, of which the diagram is shown in more detail in FIG. 2, comprises a MOSFET 1 with a gate g, a drain d, and a source s. The gate g of the MOSFET 1 is connected via a resistor R2 to a voltage divider network, which is connected electrically in parallel to the input filter means I, which comprises a series arrangement of a resistor R1 and a capacitor C1. The capacitor C1 is shunted by a zener diode Z1. The drain d of the MOSFET 1 is directly connected to the positive pole + of the input filter means I. The source s is connected to the negative pole − of the input filter means I via a series arrangement of a resistor R11 and a zener diode Z11. E denotes a connection point of the self-regulating current-conducting network for connection to a stabilized low-voltage supply which forms part of the circuit arrangement. The self-regulating current-conducting network II in the activated state forms, through the connection point E, a supply source for the stabilized low-voltage supply.

FIG. 2 also shows means IV included in the circuit arrangement for deactivating the self-regulating current-conducting network II when the converter III is switched on. A switch SR is, for this purpose, connected, on the one hand, to a common junction point of the resistor R1 and the capacitor C1, and on the other hand, to an auxiliary voltage V−. A control electrode of the switch SR is connected to the positive pole + by means of a voltage divider. When the control unit is switched on, i.e., for switching on the converter III, the voltage at the positive pole + will rise, whereupon the switch SR becomes conducting and the MOSFET 1 is cut off, so that the self-regulating current-conducting network is deactivated.

In the embodiment shown, the auxiliary voltage V− is preferably modulated by a signal which is proportional to the current flowing through the connected semiconductor light source. This is advantageous in that there is avoided that the self-regulating current-conducting network with switched-on converter III is activated each time the voltage of the connected control unit has a zero-crossing. This is realized in a further embodiment in that the means IV is connected, for example, to output terminal C of the converter or to terminal F of the low-voltage supply and, besides, the auxiliary voltage V− has a constant voltage, for example, the voltage of the negative pole. In an advantageous manner, there is thus also realized that the self-regulating current-conducting network is deactivated by the means IV on the basis of current supplied by the semiconductor light source when the converter is switched on, without the hazard of the network being activated when the voltage of the control unit has a zero-crossing.

Figure 3:
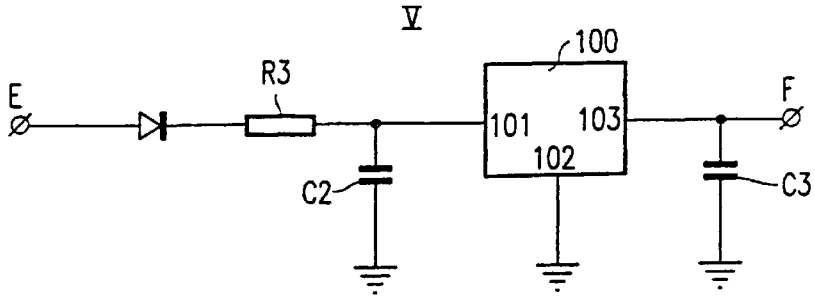
FIG. 3 is a circuit diagram of a stabilized low-voltage supply.

Although the means for deactivating the self-regulating current-conducting network is indicated as separate means IV in the drawing, the means IV preferably forms part of the control circuit of the converter III. FIG. 3 shows a stabilized low-voltage supply unit V which forms part of the circuit arrangement. The stabilized low-voltage supply V is connected with an input to connection point E of the self-regulating current-conducting network II, which thus forms, when in the activated state, a supply source for the stabilized low-voltage supply. The connection point E is connected to a pin 101 of an integrated circuit (IC) 100 via a diode D1 and a network of a resistor R3 and a capacitor C2. A pin 103 of the IC 100 forms an output pin carrying a stabilized low voltage which can be taken off by means of connector F. The pin 103 is connected to ground via a capacitor C3. A pin 102 of the IC 100 is also connected to ground.

In a practical realization of the embodiment of the circuit arrangement according to the invention as described above, this circuit arrangement is suitable for connection to a control unit supplying a voltage in the conducting state of at least 80 V, 60 Hz, and at most 135 V, 60 Hz, and which is suitable for operating a semiconductor light source comprising a matrix of 3×6 LEDs, made by Hewlett-Packard, with a forward voltage $V_F$ of between 2 V and 3 V, defined at 250 mA and at an ambient temperature of 25° C. A rectified voltage with an effective value of at least 80 V and, at most, 135 V is present at the positive pole + of the input filter means when the converter is in the activated state. The MOSFET 1 of the self-regulating current-conducting network II is of the IRF 820 type (made by IRF). The zener diode Z1 has a zener voltage of 15 V, the zener diode Z11, 5.6 V. The capacitor C1 has a value of 330 pF, and the resistors R1, R2, and R3 have values of 240 kΩ, 10 kΩ, and 220 kΩ, respectively. When the control unit is disconnected, this results in a maximum current through the MOSFET 1 of 31 mA, which corresponds to a voltage at the input terminal A of at most 10 Vrms. This corresponds to the maximum admissible voltage level for the control unit in the disconnected state which will just lead to a correct outcome of a status test of the control unit.

The switch SR is of the BCX70 type (made by Philips). The IC 100 is of the 78L09 type (made by National Semiconductors) and supplies a stabilized low voltage of 9 V with an accuracy of 1%. The resistor R3 has a value of 10 Ω and the capacitors C2 and C3 each have a capacitance value of 1 μF.

Figure 4:
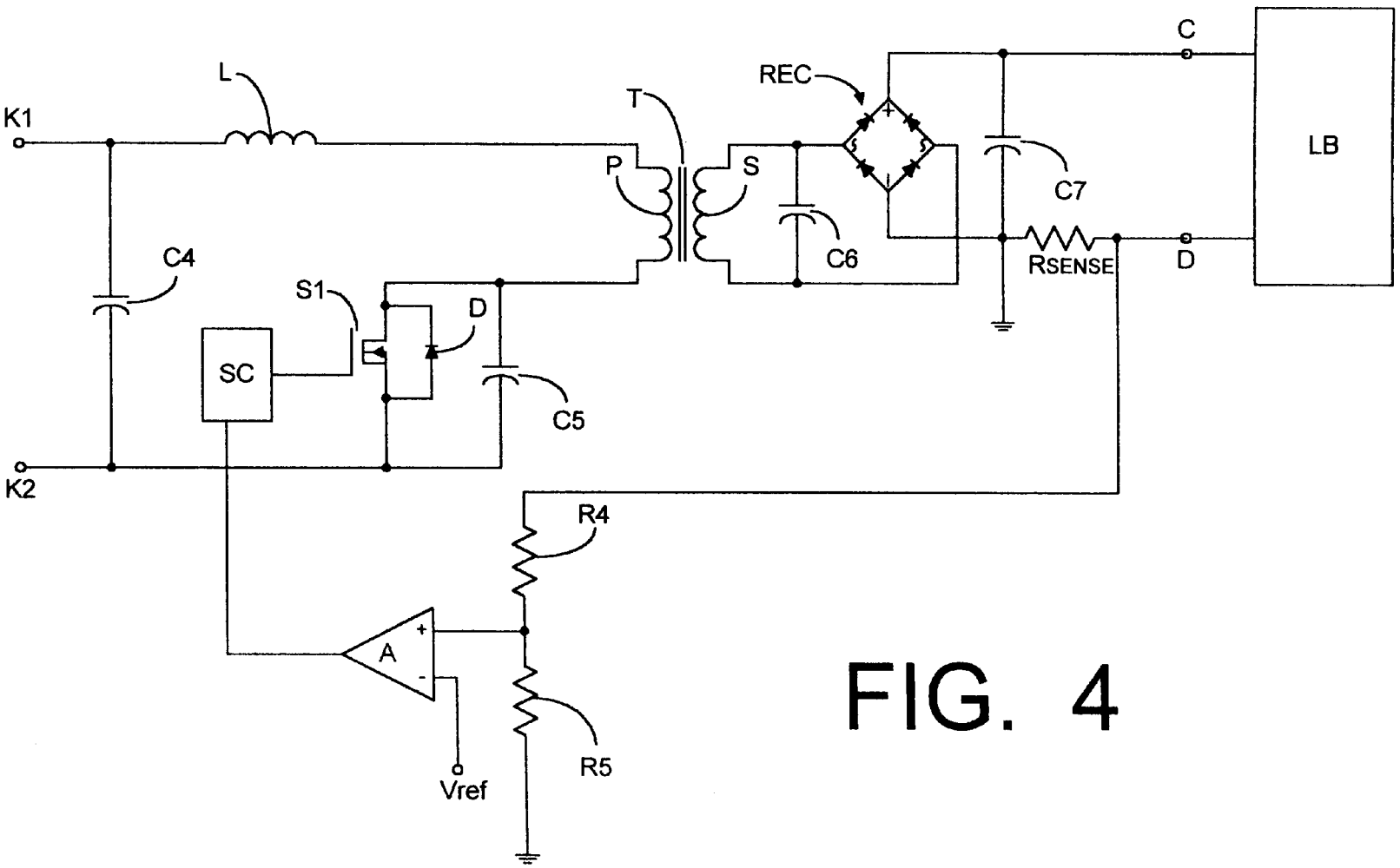
FIG. 4 is a circuit diagram showing a converter with a control circuit.

FIG. 4 shows a schematic diagram of the converter III with the control circuit. K1 and K2 in this embodiment form input terminals for connection to a DC voltage source. K1 and K2 are interconnected by means of a capacitor C4 which serves as a buffer capacitance. The input terminals K1 and K2 are also interconnected by a series arrangement of a coil L, a primary winding P of a transformer T, and a capacitor C5. The capacitor C5 is shunted by a switching element S1 whose control electrode is connected to an output of a control circuit SC for rendering the switching element S1 conducting and non-conducting with high frequency. An input of the control circuit SC is connected to an output of an amplifier A. A first input of the amplifier A is connected to a reference voltage Vref which is present during operation of the circuit arrangement. A second input of the amplifier A is connected to a common junction point of a resistor R4 and NTC R5. A first end of the series arrangement of resistor R4 and NTC R5 is connected to a terminal D. A second end of the series arrangement is connected to ground. A diode D forms part of the switching element S1. A secondary winding S of the transformer T is shunted by a capacitor C6. Ends of the secondary winding S are connected to respective input terminals of a diode rectifier bridge REC. Output terminals of the diode rectifier bridge REC are interconnected by a capacitor C7 which acts as a buffer capacitance. The positive output terminal of the diode bridge is connected to the terminal C. The negative output terminal of the diode rectifier bridge REC is connected to ground and, through a resistor Rsense, to the terminal D. The terminal C and D form the output terminals of the converter. The semiconductor light source LB is connected to these output terminals C and D. In the "off" state of the converter, the control circuit SC keeps the switching element S1 in its non-conducting condition, while in the "on" state of the converter, the control circuit SC cyclically switches the switching element S1 between the conducting and non-conducting conditions at a high frequency.

Figure 5:
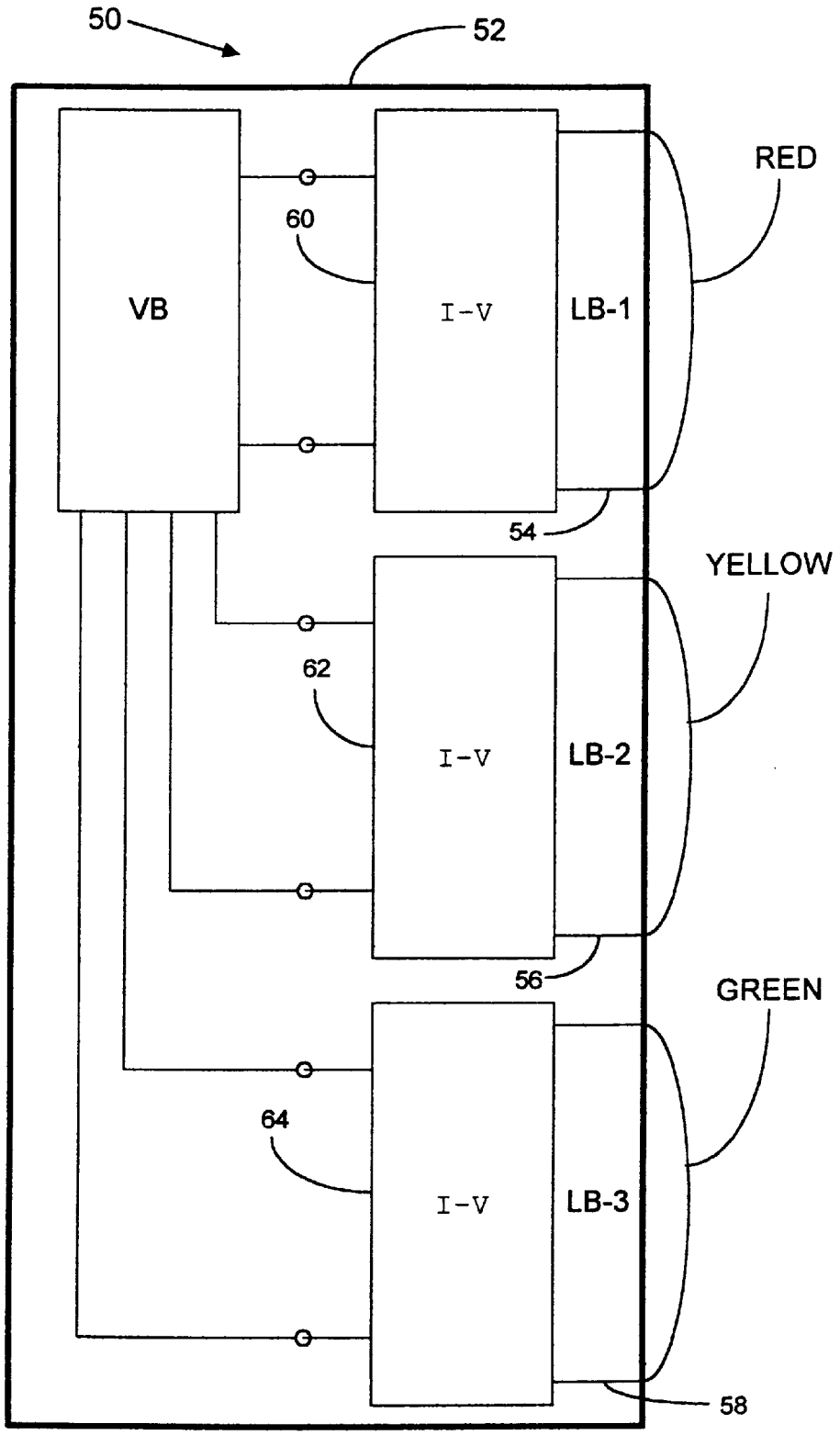
FIG. 5 is a diagram of a traffic light having a semiconductor light source as a signalling light, and the circuit arrangement of the subject invention.

FIG. 5 shows a diagram of a traffic light 50 for use in a traffic control system. The traffic light 50 includes a housing 52 which contains three signalling light lenses—RED, YELLOW, GREEN. Each of the lenses receives light from a respective signalling light in the form of semiconductor light sources LB-1, LB-2 and LB-3, each arranged in respective housings 54, 56 and 58 within the housing 52 of the traffic light 50. Each of the semiconductor light sources LB-1, LB-2 and LB-3 has an associated circuit arrangement (I–V) which are each arranged in respective housings 60, 62 and 64, these housing being integrated with the housings 54, 56 and 58, respectively, of the semiconductor light sources LB-1, LB-2 and LB-3. Each of the circuit arrangements (I–V) selectively receive power from the control unit VB.

What is claimed is:

1. A circuit arrangement for operating a semiconductor light source, said circuit arrangement comprising:

connection terminals for connecting the circuit arrangement to outputs from a control unit for controlling the semiconductor light source;

input filter means coupled to the connection terminals;

a converter comprising a control circuit, said converter being coupled to output means of the input filter means; and output terminals for coupled to output means of said converter for connecting said circuit arrangement to the semiconductor light source, characterized in that said converter comprises a switched-mode power supply for providing power to said semiconductor light source, said switched-mode power supply having a switching element which is cyclically switched on and off by said control circuit, and the circuit arrangement further comprises a self-regulating current-conducting network coupled between said filter means and said converter, said self-regulating current-conducting network draining off a leakage current in the control unit when said control unit is in a non-conducting state.

2. The circuit arrangement as claimed in claim 1, characterized in that the circuit arrangement comprises means or deactivating the self-regulating current-conducting network hen the converter is switched on.

3. The circuit arrangement as claimed in claim 1, characterized in that the circuit arrangement further comprises a stabilized low-voltage supply, the self-regulating current-conducting network, in an activated state, forming a supply source for said stabilized low-voltage supply.

4. A signalling light provided with a housing containing a semiconductor light source and a control unit for controlling the semiconductor light source, characterized in that the signalling light is provided with a circuit arrangement for operating the semiconductor light source, said circuit arrangement comprising:

connection terminals for connecting the circuit arrangement to outputs from the control unit;

input filter means coupled to the connection terminals;

a converter comprising a control circuit, said converter being coupled to output means of the input filter means; and output terminals for coupled to output means of said converter for connecting said circuit arrangement to the semiconductor light source, wherein said converter comprises a switched-mode power supply for providing power to said semiconductor light source, said switched-mode power supply having a switching element which is cyclically switched on and off by said control circuit, and wherein the circuit arrangement further comprises a self-regulating current-conducting network coupled between said filter means and said converter, said self-regulating current-conducting network draining off a leakage current in the control unit when said control unit is in a non-conducting state.

5. The signalling light as claimed in claim 4, characterized in that the circuit arrangement is provided with a housing which is integrated with a housing of the signalling light.

* * * * *